United States Patent [19]

Dudley et al.

[11] 4,066,040

[45] Jan. 3, 1978

[54] CONTINUOUS POWDER FEED SYSTEM FOR MAINTAINING A UNIFORM POWDER COATING THICKNESS ON OBJECTS BEING COATED BY ELECTROSTATIC FLUIDIZED BEDS

[75] Inventors: Michael A. Dudley, Toronto; Mellapalayam R. Parthasarathy, Verdun; Douglas C. Nerthersole, Laval, all of Canada

[73] Assignee: Canada Wire and Cable Limited, Toronto, Canada

[21] Appl. No.: 683,775

[22] Filed: May 6, 1976

[30] Foreign Application Priority Data

Feb. 26, 1976 Canada ..... 246616

[51] Int. Cl.[2] ..... B05C 19/02

[52] U.S. Cl. ..... 118/629; 118/309

[58] Field of Search ..... 118/405, 312, 309, 634, 118/DIG. 5, 603, 629, 608, 405; 427/185

[56] References Cited

U.S. PATENT DOCUMENTS

| | | | |
|---|---|---|---|
| 3,282,249 | 11/1966 | Ramsay | 118/405 X |
| 3,364,053 | 1/1968 | Beike | 427/185 X |
| 3,724,416 | 4/1973 | Diamond et al. | 118/603 X |
| 3,817,211 | 6/1974 | Brown et al. | 118/DIG. 5 |

FOREIGN PATENT DOCUMENTS

| | | | |
|---|---|---|---|
| 1,292,836 | 4/1969 | Germany | 427/185 |
| 993,566 | 5/1965 | United Kingdom | 427/185 |

*Primary Examiner*—John P. McIntosh
*Attorney, Agent, or Firm*—Fleit & Jacobson

[57] ABSTRACT

A continuous powder feed system for maintaining an essentially uniform powder cloud above an electrostatic fluidized bed coating unit is disclosed. The continuous powder feed system comprises a powder container and discharger for continuously feeding essentially non agglomerated powder into the coating bed of the electrostatic fluidized bed coating unit, powder retaining walls for containing the bed of such coating unit during fluidization, at least one powder retaining wall having a height such as to determine the powder level in the coating bed and permit overflow of excess powder from the coating bed, and a powder collection system for retrieving the overflowing powder from the coating bed.

10 Claims, 5 Drawing Figures

CONTINUOUS POWDER FEED SYSTEM FOR MAINTAINING A UNIFORM POWDER COATING THICKNESS ON OBJECTS BEING COATED BY ELECTROSTATIC FLUIDIZED BEDS

This invention relates to a system for continuously feeding powder to and removing it from the coating bed of an electrostatic fluidized bed coating unit such as to maintain an essentially uniform powder cloud above the bed.

In electrostatic fluidized bed coating processes, wherein powder deposition is effected by passage of a preferably grounded substrate through a cloud of highly charged powder particles, the consistency of the deposition rate, and hence the quality of coatings obtained over any significant time interval, is greatly dependent on maintaining (a) the cloud density at a consistent level and (b) an essentially uniform particle size distribution for that particular time interval.

Two factors which contribute to changes in cloud density under a fixed set of processing parameters are changes in the volume or level of powder in the coating bed and changes in the particle size distribution of powder with duration of the coating process.

Powder feed devices used to maintain powder levels within certain limits are usually activated by a mechanical, fluidic or electronic level sensor situated inside the coater, and supply powder to the coating bed intermittently. Level sensors have been found to respond to changes in powder depth in an inconsistent manner. Powder depth variations as great as ¼ inch have been necessary to activate the mechanical and fluidic mechanisms in some instances. Such variations, which in some cases represent 20–25% of the total powder depth, can result in significant variations in coating thicknesses achieved, under otherwise constant conditions, with time.

Also, the necessity of locating the sensor inside the coater not only results in frequent malfunctions of the mechanism due to clogging with powder, thus resulting in even greater powder-level fluctuations within the coating bed, but also disturbs the stability of the powder cloud above the bed.

The intermittent addition of powder to the bed results in a slow change of particle size distribution of powder in the bed, with a tendency for a skew to form to the heavier particles.

This in turn prevents the use of essentially constant voltage and even settings required to achieve a desired product quality due to a change in particle size of the powder deposited on the object being coated. Such a situation is not tolerable in a production operation, especially since it induces a requirement for frequently stopping the line and replacing the unsuitable powder in the bed with fresh stock.

Furthermore, the intermittent addition of uncharged powder into the fluidized charged powder results in a virtually instantaneous drop of the average charge on the powder in the bed causing momentary reduction in the thickness of powder deposited on a substrate passing through the cloud, another feature which is unacceptable in production practice.

It is the object of the present invention to provide a novel system for feeding powder in a continuous manner to an electrostatic fluidized bed so as to maintain a constant powder level, and a greatly reduced rate of change of powder particle size distribution within the coater bed.

The continuous powder feed system, in accordance with the invention, comprises a powder container and discharger for continuously feeding essentially non agglomerated powder into the coating bed of the powder coating unit, powder retaining walls for containing the bed of the coating unit during fluidization, at least one powder retaining wall being of a height such as to determine the powder level in the coating bed and permit overflow of excess powder from the coating bed, and a powder collection system for retrieving the overflowing powder from the coating bed.

The powder container and discharger may discharge directly into the coating bed or into a vibrating feeder, which discharges into the coating bed, to break up agglomerates and hence discharges into the bed essentially free flowing powder. The powder container and discharger may also be vibrated to assist break up of powder agglomerates.

The discharge end of the powder container and discharger or of the vibrating feeder is preferably located close to a powder retaining wall which does not control the level of powder in the bed. In a horizontal coating unit, the discharge end of the powder container and discharger or of the vibrating feeder would be located near the entry point of the object to be coated into the coating chamber whereas, in a vertical coating unit, they would be simply located adjacent the center of a powder retaining wall which does not control the powder level of the bed. Preferably, a baffle is provided for channelling the powder entering the coating bed initially away from the coating area to facilitate optimum charging of the powder prior to deposition.

The powder collection system preferably comprises an extension of at least one wall of the coating chamber, a downwardly sloping floor for such extension secured to the upper edge of each powder retaining wall which control the powder level in the bed and openings at the lower end of such sloping floor through which the excess powder flows.

The powder retaining wall or walls of the coating bed which control the powder level in the bed may also be made adjustable in height so as to vary the powder level of the coating bed.

The invention will now be disclosed, by way of example, with reference to the accompanying drawings in which.

Figure 1:
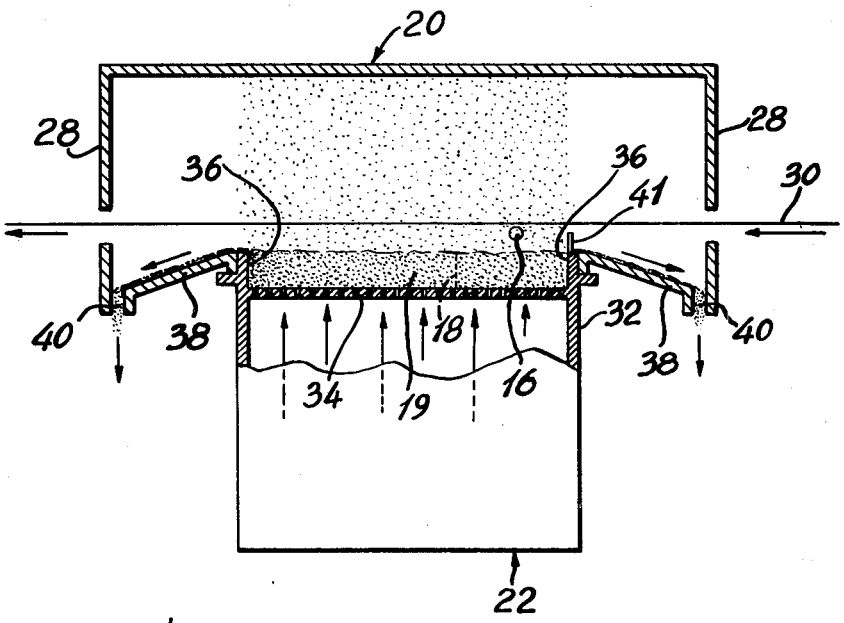
FIGS. 1 and 2 illustrate front and side views, respectively, of a horizontal coating unit.
Figure 2:
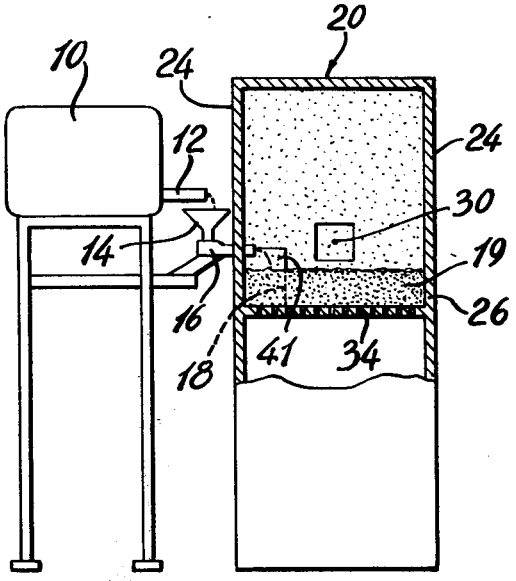
Figure 3:
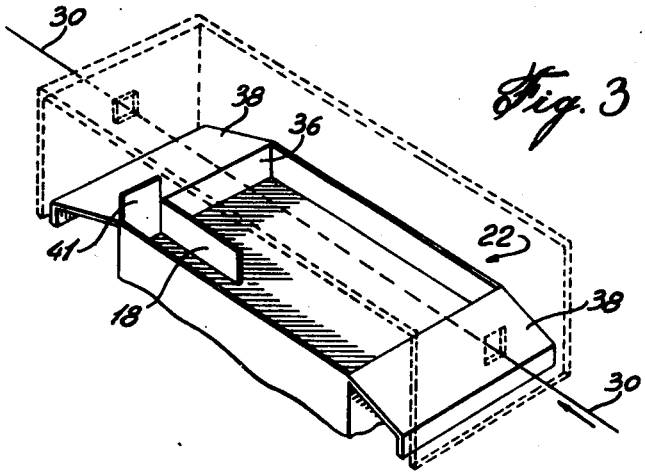
FIG. 3 illustrates a top perspective view of the coating bed.

Referring to FIGS. 1 and 2, there is shown a powder container and discharger 10 which may be a standard volumetric helix feeder with an oscillating blade type agitator to prevent powder compaction and a feed helix for moving the powder through the cylindrical discharge spout 12 of the powder container and discharger. Of course, any suitable powder container and discharger may be used. The discharge spout of the powder container and discharger discharges into a hopper 14 which empties into a vibrating feeder 16 which serves to break up agglomerates and hence discharges essentially free flowing powder. The discharge spout of the vibrating feeder discharges into a baffled section formed by baffle 18 inside electrostatic fluidized bed coating bed 19 as more clearly shown in FIG. 3. The purpose of the baffle 18 is to channel the powder entering the coating bed initially away from the coating area to facilitate optimum charging of the powder prior to deposition. In a horizontal coating unit such as illustrated in FIGS. 1 and 2, the powder is introduced near the entry point of the object to be coated into a coating chamber 20. It is to be understood that the use of the vibrating feeder 16 is optional and that the powder container and discharger may discharge directly into the coating bed 19, provided the powder is in an essentially non-agglomerated form.

The electrostatic fluidized bed coating chamber 20 is attached to the top of the plenum chamber 22 of the coating unit. The lateral walls 24 of coating chamber 20 are in the same plane as the lateral walls 26 of the plenum chamber 22 but the end walls 28 of coating chamber 20, through which objects such as substrate 30 to be coated enter and exit, extend beyond the end walls 32 of the plenum chamber 22. The top of the plenum chamber is closed by a porous plate 34 through which a suitable gas is fed for fluidizing the bed in a known manner. The porous plate is located at a predetermined distance below the upper edge of the walls of the plenum chamber 22 and the upper portion of these walls form powder retaining walls for the coating bed. The height of at least one of such retaining walls as illustrated by reference numeral 36 determines the powder level in the coating bed. The overflow of excess powder from the coating bed flows down a sloping floor 38 secured to the side of retaining wall 36 and through suitable openings 40 to a powder collection device (not shown). When powder is fed into the coating bed adjacent a retaining wall which controls the powder level in the coating bed, an extension 41 is preferably provided for preventing newly fed powder from overflowing down the sloping floor 38.

Figure 5:
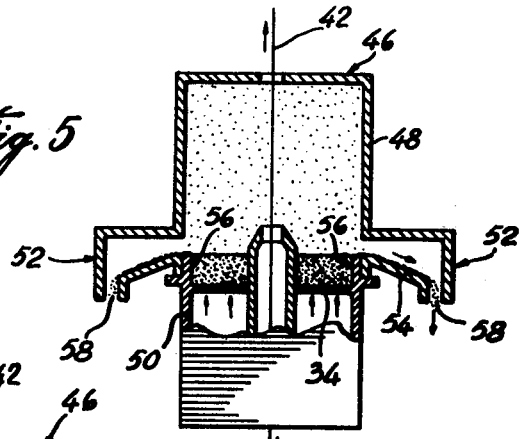
FIGS. 4 and 5 illustrate front and side views, respectively, of a vertical coating unit.
Figure 4:
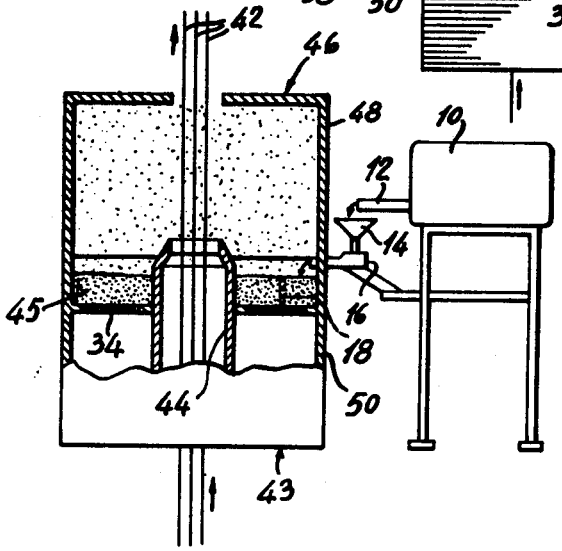

The vertical coating unit illustrated in FIGS. 4 and 5 is very similar to the coating unit of FIGS. 1 and 2 except that the substrate or substrates 42 to be coated enter the bottom of a plenum chamber 43 and passes through a chamber 44 located in such plenum chamber and extending a short distance above the fluidized bed 45. The substrate exists through the top of the coating chamber 46. The powder feed mechanism is identical to the one of FIGS. 1 and 2 and identified by the same reference characters. The walls 48 of the coating chamber 46 are in the same virtual plane as the walls 50 of the plenum chamber except for the extension 52 on opposite walls of the coating chamber. Such extensions include sloping floor 54 secured to the side of retaining walls 56 and openings 58 to permit overflow of excess powder from the coating bed over retaining walls 56 which correspond to retaining walls 36 in the embodiment of FIGS. 1 and 2.

Prior to commencement of the coating operation, the coating bed is filled with sufficient powder to ensure an overflow condition during its fluidization-induced expansion. Powder is then added to the bed continuously from the feed apparatus at a rate sufficient to just maintain this overflow condition throughout the coating operation. In this way, a constant powder level in the bed is assured, without too great a recycle of powder.

Powder overflow is preferentially allowed to occur at either one or both of the two facing retaining walls which control the powder level of the bed onto the sloping floors from where it passes for re-use through the appropriately located openings. It is obvious that the quantity of a given powder necessary to result in an overflow condition will be a function of the fluidizing air pressure or airflow, which regulates the degree of expansion in the bed, and the height of the retaining walls of the coating bed. The retaining walls which control the powder level may be made adjustable in height to change the powder level in the bed, to satisfy specific requirements.

It has been found that by utilizing the continuous powder feed-overflow system described wherein the powder level is kept constant, cloud density stability in the coating chamber has improved significantly and coating thicknesses have been more consistent in comparison to results obtained using prior art methods. Mechanically, the system performs in a superior, more consistent and reliable manner than prior art using a level sensor system.

It has also been found that particle size distribution variation of the powder in the coating bed is significantly reduced in runs utilizing the continuous feed-overflow system in comparison to runs involving prior art powder feeding systems. This distribution variation with time of operating evident in prior art operation, especially in powders which have a wide distribution, is attributable to preferential deposition of the finer particles especially in the initial stages of the coating operation and also to higher losses of these particles to the powder-recovery system. In prior art powder feed systems wherein fresh powder is being added to the bed only intermittently, the reduction in the percentage of finer particles and therefore the change in particle size distribution is significantly greater than is the case where fresh powder is added to the bed in a continuous manner. Consequently, cloud density decrease is more rapid and coating thicknesses decrease correspondingly.

A further finding is that the continuous trickle feeding of an essentially deagglomerated powder as opposed to an intermittent heavy volume feeding of the somewhat agglomerated powder of the prior art, eliminates the intermittent cloud collapse which occurs at the commencement of intermittent feeding presumably due to the large mass of uncharged powder entering at that time.

The suprising results obtained using the continuous feed system are best illustrated by the following non-limitative example utilizing a copper electrical conductor as the object to be coated, and comparing the results so obtained with prior art operations.

EXAMPLE

A specific example of the embodiment of this invention is given below:

A comparison of average coating thickness values obtained at various time intervals using the continuous trickle feed-overflow (C.T.F.O.) system and the prior art, level-sensor intermittent (L.S.I.) powder feed system is shown in Table I. Values were obtained in horizontal coating application of an ionomeric resin onto 25 AWG round copper conductor. The residence of the conductor in the coating unit was 0.8 seconds and thickness measurements of the fused coatings were made at the time intervals indicated in the Table. Each result is the average of 18 readings taken over approx. 100 ft. of sample.

TABLE I

| COATING THICKNESS VARIATION WITH TIME | | |
|---|---|---|
| TIME INTERVAL | THICKNESS (in./side) | |
| (Minutes) | L.S.I. | C.T.F.O. |
| 1 | 0.008 | 0.008 |
| 10 | 0.007 | 0.009 |
| 20 | 0.008 | 0.008 |
| 30 | 0.006* | 0.008 |
| 35 | 0.007 | — |
| 40 | 0.006* | 0.008 |
| 45 | 0.006 | 0.007 |
| 55 | 0.005* | 0.007 |
| 60 | 0.006 | 0.008 |

*Measurement made when powder level in coating bed was minimum. Other L.S.I. determinations were made with powder level at or close to maximum.

Table II gives a comparison of the particle size distributions of the powders, initially loaded into the coater bed, and after 1 hour of continuous operation using prior art L.S.I. and the disclosed C.T.F.O. techniques. The Table also shows the powder distribution after using the C.T.F.O. technique for sixteen hours continuously.

It can be seen that while the powder remaining in the bed after one hour operation according to prior art has an increased weight of large particles, there is virtually no change in the particle size distribution of the powder remaining in the bed using the disclosed continuous feed technique. More surprisingly after 16 hours of continuous operation there is still no significant change in powder distribution using the C.T.F.O. technique.

This has resulted in a maintenance of product coating thickness with time for the C.T.F.O. technique, whereas with the prior art L.S.I. technique a significant reduction in average coating thickness is recorded after only a short time of operation, as shown in Table I. This reduction in thickness with time continues, when the intermittent feed system is used, making necessary process parameter adjustments and eventually replacement of the powder in the bed.

Table I also demonstrates the variation in coating thickness due to the approximately ⅛ inch change in powder level caused by intermittent feeding.

TABLE II

| PARTICLE SIZE DISTRIBUTION CHANGE IN COATER BED WITH TIME PARTICLE SIZE DISTRIBUTION (% by weight) | | | | | |
|---|---|---|---|---|---|
| Screen Size | Initial | | After 60 minutes | | After 16 hrs |
| (Microns) | L.S.I. | C.T.F.O. | L.S.I. | C.T.F.O. | C.T.F.O. |
| >177 | 0 | 0 | 0 | 0 | 0 |
| <177; >149 | 0 | 0 | 0 | 0 | 0 |
| <149; >105 | 0 | 0.9 | 1.3 | 0.7 | 1.2 |
| <105; > 74 | 8.8 | 10.9 | 16.8 | 12.8 | 12.7 |
| < 74; > 37 | 51.4 | 53.7 | 58.9 | 53.3 | 52.7 |
| < 37; | 39.3 | 34.3 | 23.8 | 33.2 | 33.4 |

Although the invention has been disclosed with reference to preferred embodiments of the invention, it is to be understood that it may be used with other types of electrostatic fluidized bed coating units and that the invention is to be limited by the claims only.

What is claimed is:

1. A continuous powder feed system for feeding powder to and removing it from the coating bed of an electrostatic fluidized bed coating unit of the type wherein an object to be coated is passed through a cloud of electrically charged particles located above the fluidized powder bed, such as to maintain an essentially uniform powder cloud above the bed comprising:

a. a powder container and discharger means for continuously feeding powder into said coating bed in an essentially non-agglomerated form;

b. means for channelling the powder entering the coating bed away from the coating area initially to facilitate optimum electrostatic charging of the powder prior to deposition;

c. powder retaining wall means for containing the bed of said coating unit during fluidization comprising a plurality of powder retaining walls, at least one of said powder retaining walls having a height such as to determine the powder level in the coating bed and permitting a uniform overflow of excess powder from the coating bed across the length of said at least one of said powder retaining walls; and d. a powder collection system for retrieving the overflowing powder from the coating bed.

2. A continuous powder feed system as defined in claim 1, wherein said powder container and discharger means discharges directly into the coating bed.

3. A continuous powder feed system as defined in claim 2, wherein said powder retaining wall means comprises a powder retaining wall which does not control the powder level in the coating bed and wherein the discharge end of the powder container and discharger means is located close to the powder retaining wall which does not control the powder level in the coating bed.

4. A continuous powder feed system as defined in claim 1, further comprising a vibrating feeder which discharges directly into the coating bed, said powder container and discharger means discharging into said vibrating feeder.

5. A continuous powder feed system as defined in claim 4, wherein said powder retaining wall means comprises a powder retaining wall which does not control the powder level in the coating bed, and wherein the discharge end of the vibrating feeder is located close to the powder retaining wall which does not control the powder level in the coating bed.

6. A continuous powder feed system as defined in claim 1, wherein said powder container and discharger means is vibrated to assist break up of powder agglomerates.

7. A continuous powder feed system as defined in claim 1, wherein said powder retaining wall means comprises a powder retaining wall which does not control the powder level in the coating bed, and wherein the coating unit is a horizontal coating unit in which an object to be coated passes horizontally above said coating bed and wherein powder is discharged in the coating bed near the entry point of the object close to the powder retaining wall which does not control the powder level in the bed.

8. A continuous powder feed system as defined in claim 1, wherein said powder retaining wall means comprises a powder retaining wall which does not control the powder level in the coating bed, and wherein the coating unit is a vertical coating unit in which the object to be coated enters from the bottom of the coating unit and passes through the bed, and wherein powder is discharged into the bed adjacent the center of the powder retaining wall which does not control the powder level in the bed.

9. A continuous powder feed system as defined in claim 1, further comprising a coating chamber located on top of said coating bed and wherein said powder collection system comprises an extension of at least one wall of said coating chamber, a downwardly sloping floor for said extension secured to the side of said at least one of said powder retaining walls and openings at the lower end of said sloping floor through which the excess powder flows.

10. A continuous powder feed system as defined in claim 1, wherein said at least one of said powder retaining walls is adjustable in height.

* * * * *

UNITED STATES PATENT AND TRADEMARK OFFICE

CERTIFICATE OF CORRECTION

PATENT NO. : 4,066,040

DATED : January 3, 1978

INVENTOR(S) : Michael A. DUDLEY et al

It is certified that error appears in the above-identified patent and that said Letters Patent are hereby corrected as shown below:

In Section [75], after "Inventors:", change "Nerthersole" to read --Nethersole--.

Signed and Sealed this

*Eleventh* Day of *July 1978*

[SEAL]

*Attest:*

RUTH C. MASON
*Attesting Officer*

DONALD W. BANNER
*Commissioner of Patents and Trademarks*